United States Patent [19]

Correll, Jr. et al.

[11] Patent Number: 5,008,999

[45] Date of Patent: Apr. 23, 1991

[54] METHOD OF ASSEMBLING COMPONENTS TO ELECTRICAL TERMINALS

[75] Inventors: Robert S. Correll, Jr., Harrisburg; David D. Wiltraut, Hershey, both of Pa.

[73] Assignee: AMP Incorporated, Harrisburg, Pa.

[21] Appl. No.: 502,082

[22] Filed: Mar. 29, 1990

[51] Int. Cl.[5] ..... H01R 43/04

[52] U.S. Cl. ..... 29/882; 29/33 M; 29/569.2; 29/564.3; 29/876

[58] Field of Search ..... 29/882, 33 M, 566.2, 29/564, 4, 564.3, 883, 564.2, 876

[56] References Cited

U.S. PATENT DOCUMENTS

| | | | |
|---|---|---|---|
| 3,009,130 | 11/1961 | Redslob et al. . | |
| 3,618,207 | 11/1971 | Sand et al. | 29/883 X |
| 3,709,023 | 1/1973 | Thode | 72/402 |
| 3,965,559 | 6/1976 | Mazzola | 29/564.2 |
| 4,376,339 | 3/1983 | Ammon et al. | 29/876 |
| 4,452,103 | 6/1984 | Lijewski et al. | 74/817 |
| 4,551,901 | 11/1985 | Bonifanti et al. | 29/564.6 |
| 4,607,517 | 8/1986 | Finzer et al. | 72/449 |
| 4,612,700 | 9/1986 | Loomis et al. | 29/564.6 |
| 4,780,097 | 10/1988 | Piscitelli | 29/882 X |
| 4,907,324 | 3/1990 | Shah et al. | 29/33 M |

*Primary Examiner*—Carl J. Arbes
*Attorney, Agent, or Firm*—David L. Smith

[57] ABSTRACT

A strip (20) of electrical terminals (10) having barrel portions (14) advanced intermittently through a ferrule assembly station (AS) and a ferrule (22) is assembled to the barrel portion (14) of each terminal (10) when it has reached the assembly station (AS). A shuttle (30) is used to align a ferrule (22) with the barrel portion (14) of each terminal (10) when it is at the assembly station (AS), between the barrel portion (14) and an insertion tool (32) which is used to push the ferrule (22) from the shuttle and over the barrel portion of the terminal (10).

9 Claims, 14 Drawing Sheets

METHOD OF ASSEMBLING COMPONENTS TO ELECTRICAL TERMINALS

FIELD OF THE INVENTION

This invention relates to a method of assembling components, for example ferrules to electrical terminals connected together in side by side spaced relationship by means of a carrier strip, the ferrules being assembled to barrel portions or pin portions, for example, of the terminals. Ferrules are commonly used for providing a closed seam entry in a stamped and formed terminal body.

BACKGROUND OF THE INVENTION

Electrical terminals to which components, such as ferrules, have been assembled are described in US-A3,009,130, which is hereby incorporated herein by reference. There is disclosed in US-A-4,551,901 and US-A-4,612,700, a method of assembling electrical pins to a printed circuit board, in which method, a strip of the pins connected together in side by side spaced relationship by means of a carrier strip, is advanced step by step along a feed path. Following each step, a pair of jaws of a terminal inserter is closed about the leading pin of the carrier strip to grasp that pin. The leading pin is then sheared from the strip. The terminal inserter is then moved in an assembly direction to insert the pin grasped thereby into a hole in the printed circuit board. The circuit board is then indexed to bring a further hole therein into register with the path of the inserter. The severing means and the inserter are driven by a common rotary disc cam, means for advancing the strip of terminals, being driven by a barrel cam on the same shaft as the disc cam.

SUMMARY OF THE INVENTION

It is an object of the invention to provide a rapid and simple method of assembling components, for example ferrules, to electrical terminals.

According to the invention, as briefly summarized, a strip of terminals is advanced step by step through a component assembly station and a component is assembled to each terminal upon its arrival at the assembly station. Between the said steps a shuttle carrying a plurality of the components is advanced and retracted to present a component on the shuttle at the assembly station following each step, a further component being fed onto the shuttle by virtue of each advance and retractile movement thereof. The shuttle is moved between the assembly station and an insertion tool which is used to transfer each component from the shuttle and assemble it to a terminal at the assembly station. A crimping tool and a back-up tool can be applied to each component immediately following the assembly thereof to a terminal, in order to secure the component to the terminal. In order to hold each terminal in position at the assembly station a pilot tool associated with the back-up tool may be inserted into a hole in a carrier strip connecting the terminals, immediately after the arrival of the terminal at the assembly station and before the application of the back-up tool and the crimping tool to the component.

Figure 12:
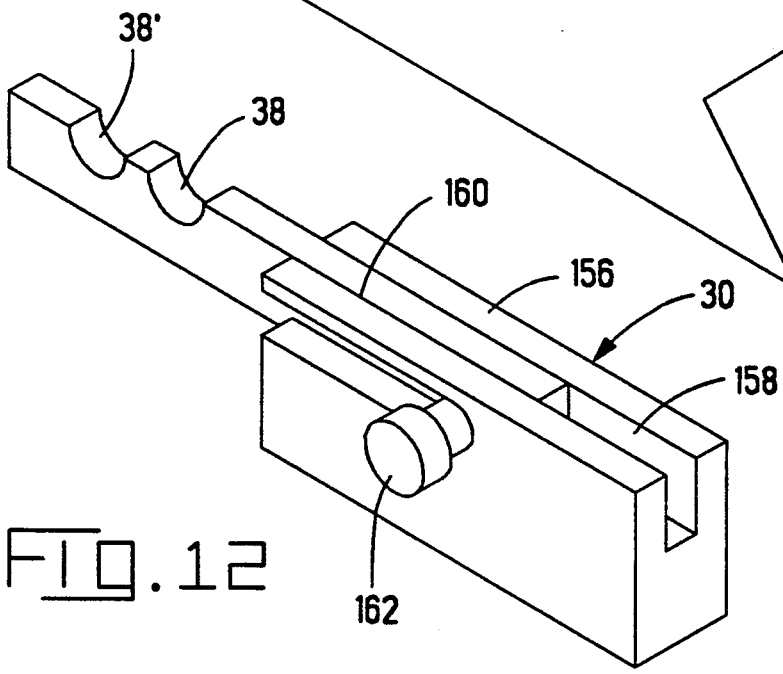
Figure 13:
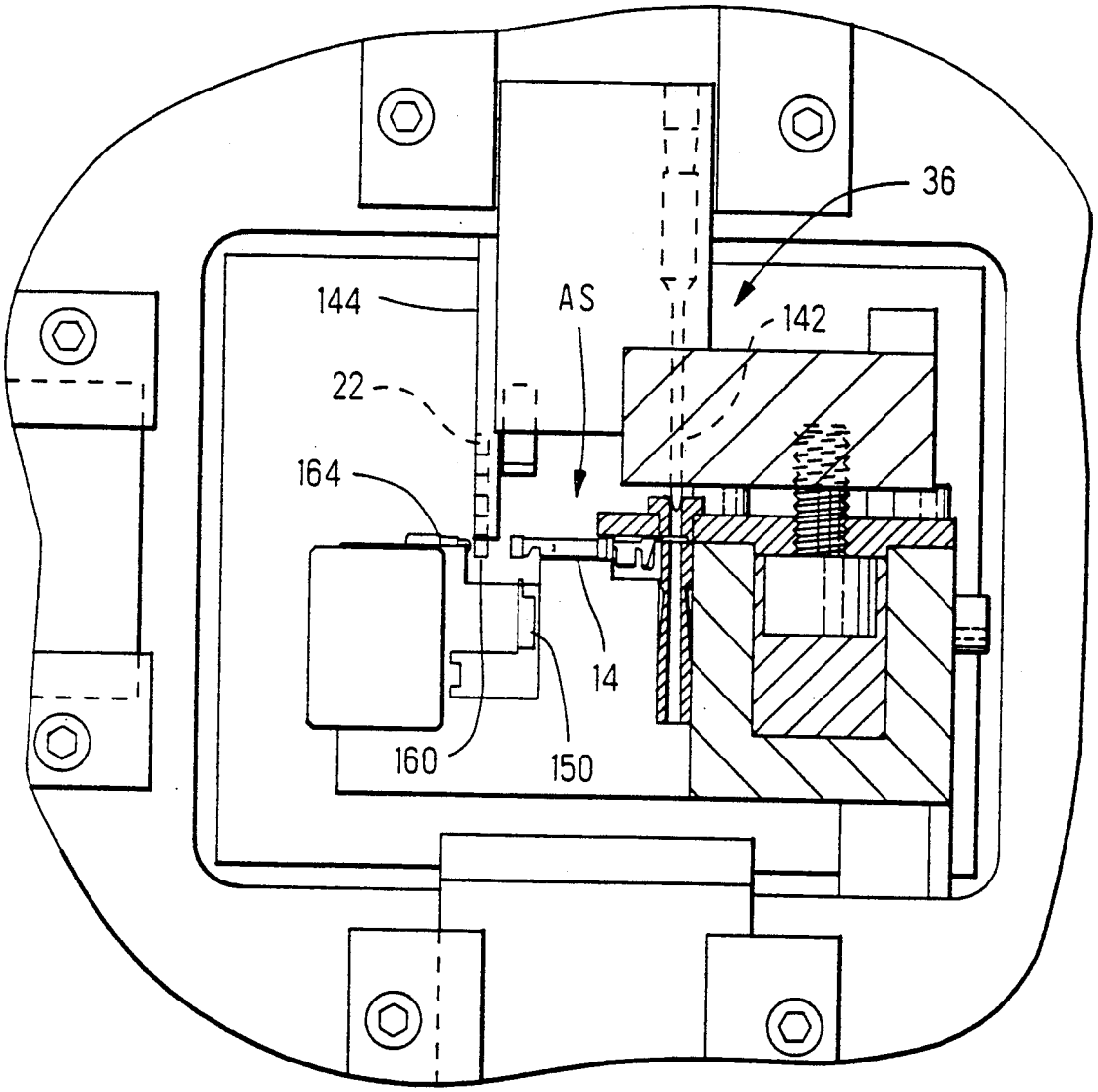
Figure 14:
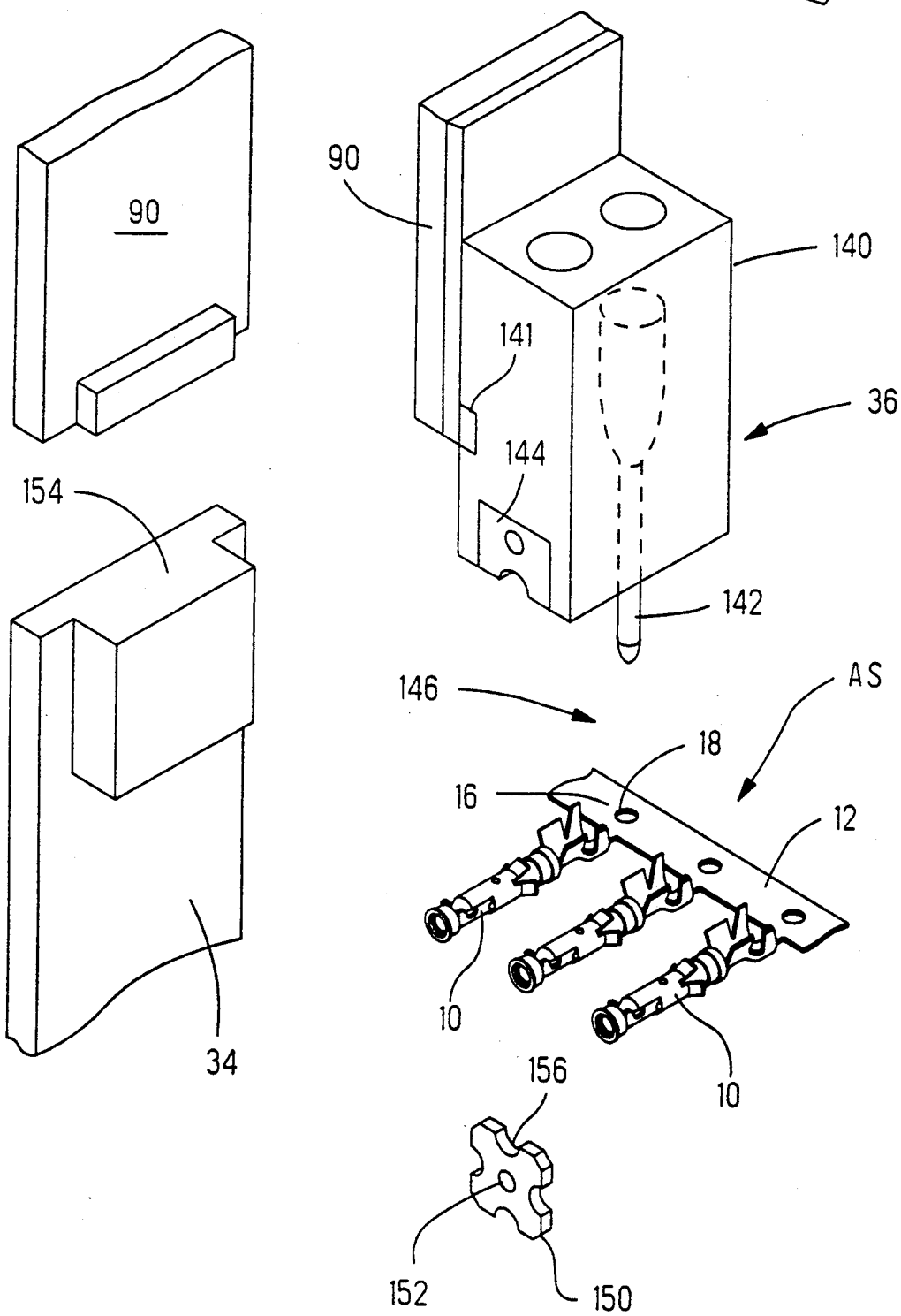
Figure 15:
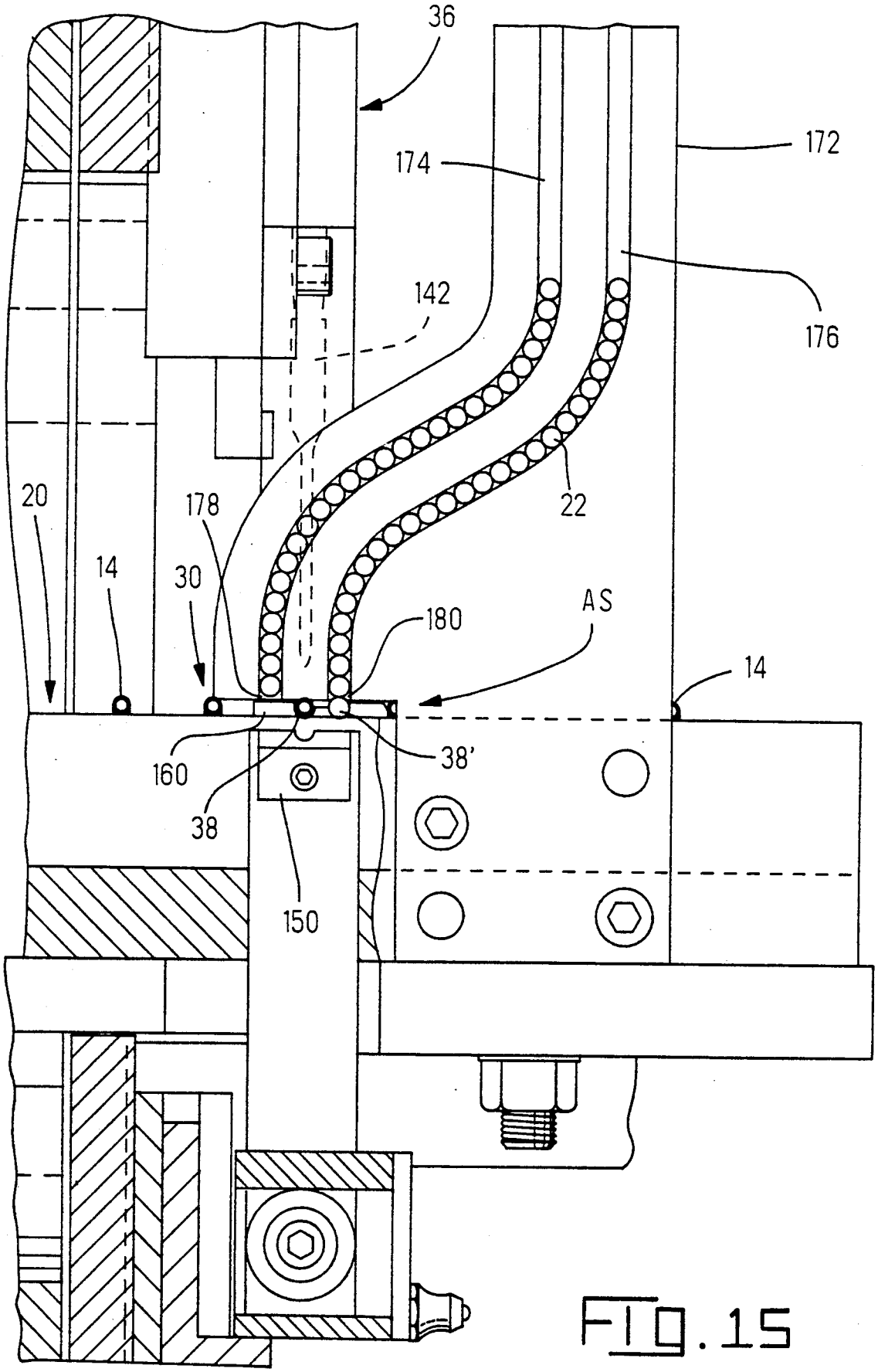
Figure 16:
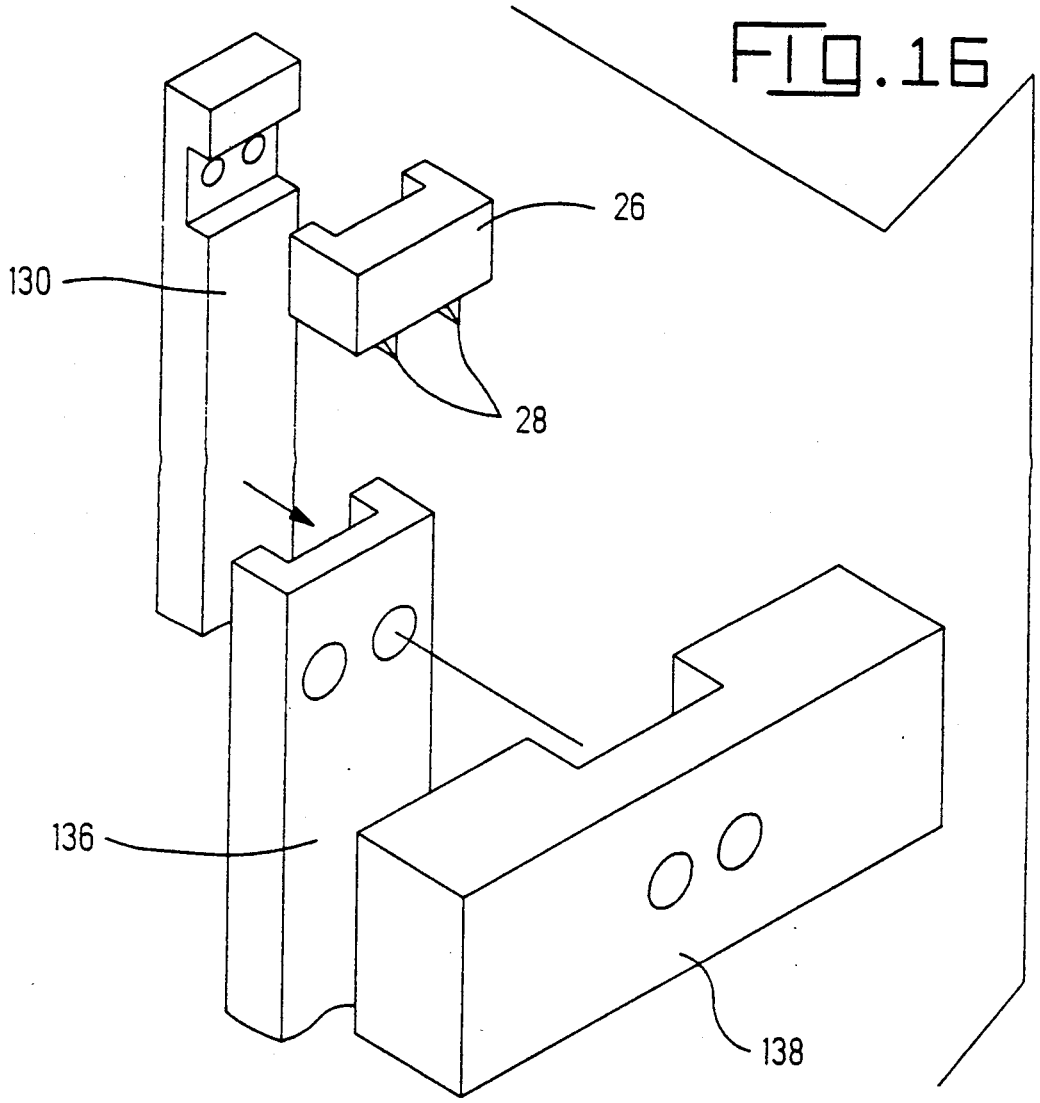
Figure 18:
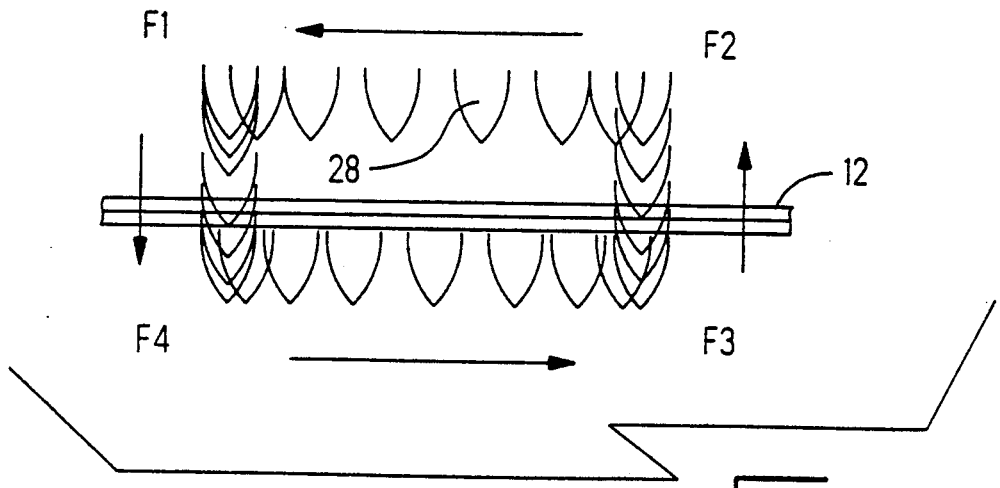
Figure 17:
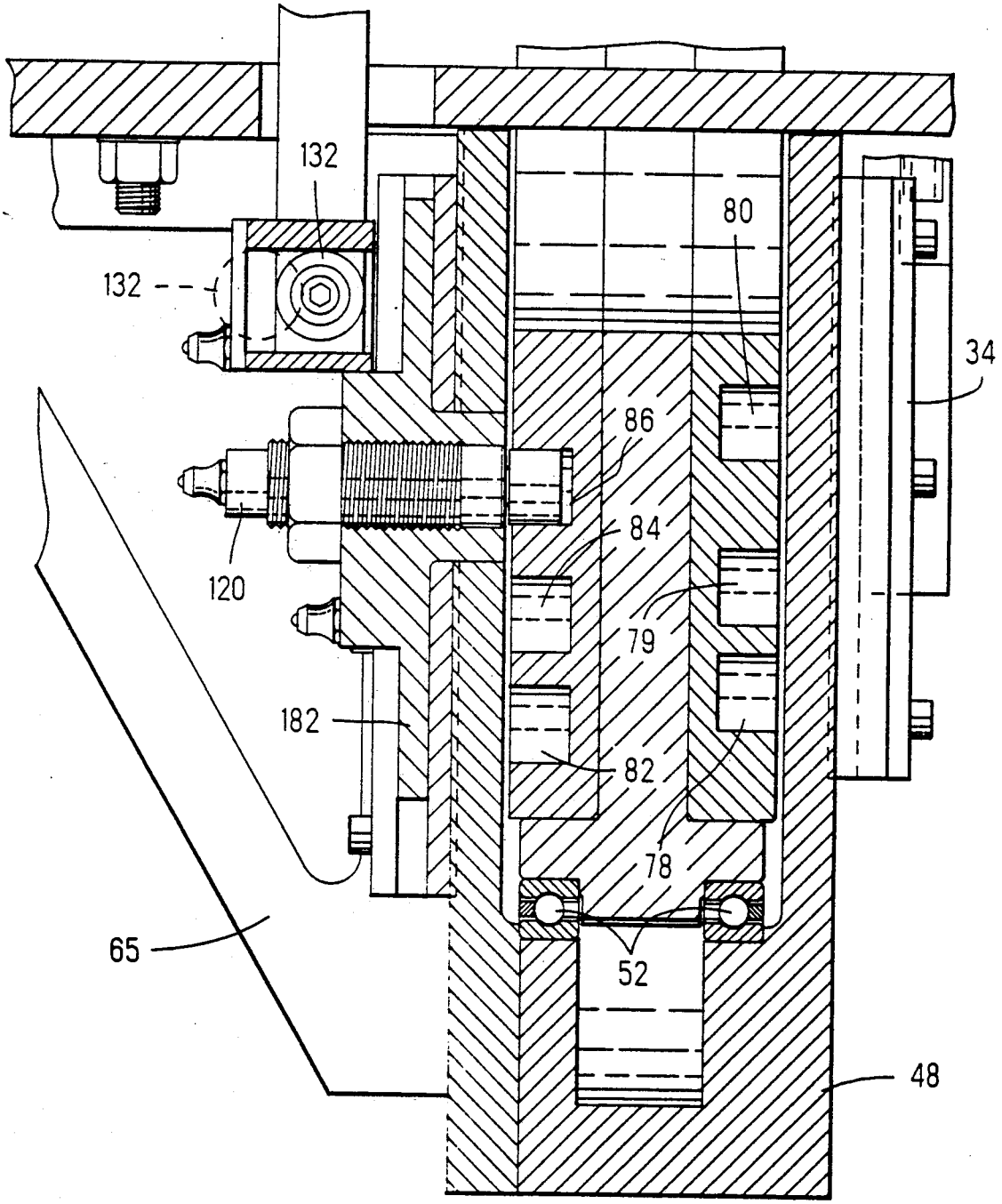
Figure 19:
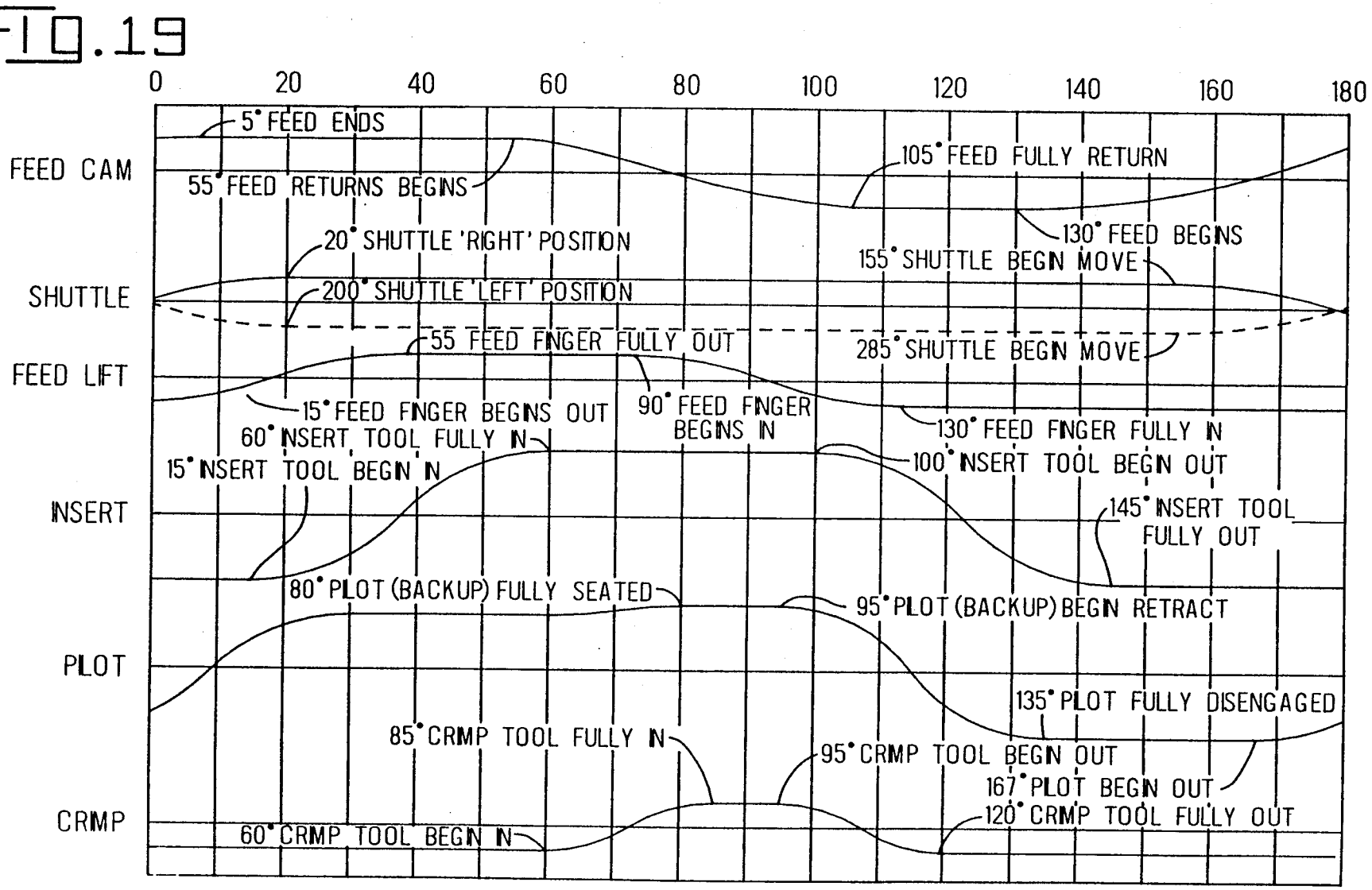

FIGURE Il is a side view of a ferrule insertion tool of the machine;

FIG. 12 is an isometric view of a shuttle assembly of the machine;

FIG. 13 is a diagrammatic fragmentary side view, shown partly in section, illustrating an assembly station of the machine;

FIG. 14 is a diagrammatic, exploded, isometric view illustrating details of said assembly station;

FIG. 15 is a diagrammatic, fraqmentary front view of the assembly station, illustrating means for feeding ferrules to a shuttle tool of the shuttle assembly;

FIG. 16 is a diagrammatic, exploded, isometric view of part of a terminal strip feed assembly of the machine;

FIG. 17 is an enlarged, fragmentary, cross sectional view of the machine illustrating details of the disc cam and of a cam follower assembly thereof;

FIG. 18 is a diagram illustrating the motion of a feed finger of the feed assembly; and FIG. 19 is a timing diagram illustrating sequences of operation of moving parts of the machine.

DESCRIPTION OF THE PREFERRED EMBODIMENT

Figure 1:
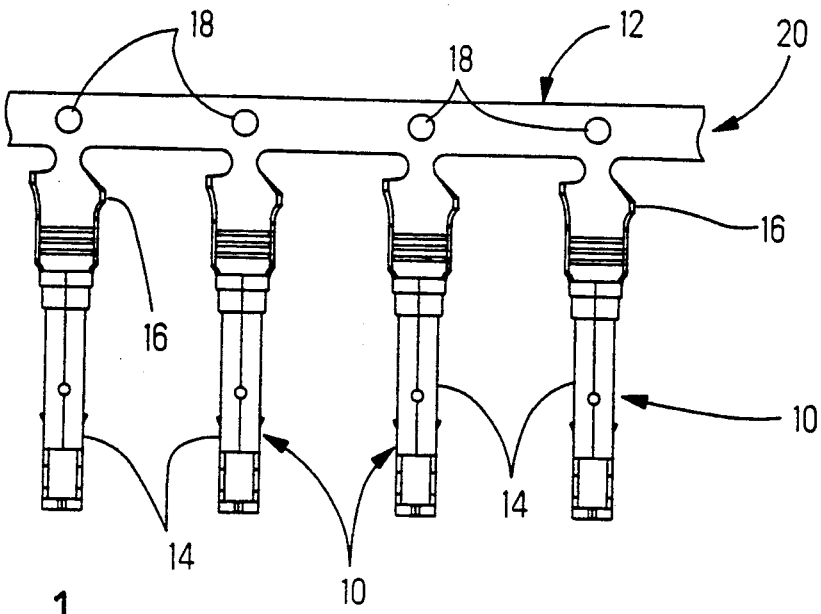
FIG. 1 is a plan view of a section of a strip of electrical terminals.
Figure 2:
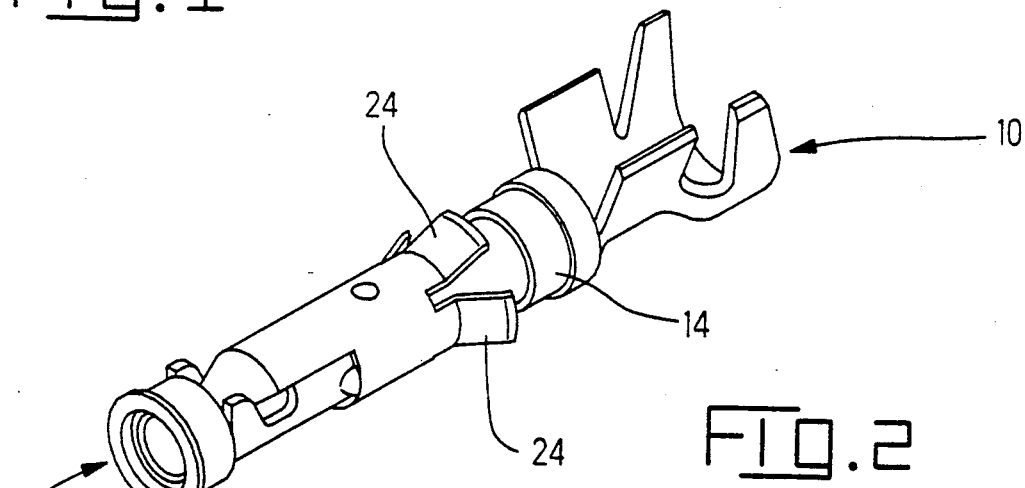
FIG. 2 is an isometric, exploded view, drawn to a larger scale than FIG. 1, and showing part of a terminal of the strip shown therein and a ferrule for assembly thereto.
Figure 3:
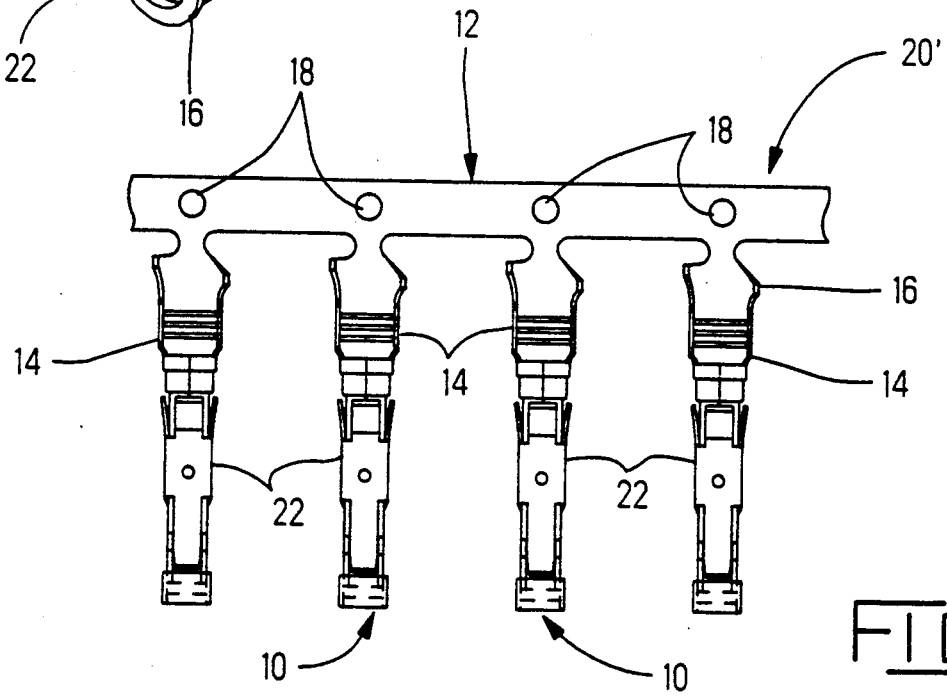
FIG. 3 is a similar view to that of FIG. 1 but showing the terminals of the strip shown therein, each with a ferrule assembled thereto.

As shown in Figure 1, electrical terminals 10 connected together in side by side spaced relationship by means of a carrier strip 12 each comprise an elongate mating portion 14 in the form of a barrel and a crimping ferrule 16 attached to the carrier strip 12 which is formed with a pilot hole 18 opposite to each terminal 10. The strip of terminals 10 is generally referenced 20. The machine, which is described below, is for assembling a ferrule 22, which is best seen in FIG. 2, to the mating portion 14 of each terminal 10 and for securing it thereto by means of a crimping operation. Each terminal 10 has spring tongues 24 for latching engagement in a cavity in an insulated housing to latch the terminal 10 therein when the terminal has been severed from the strip 12 and has been stitched into the cavity. FIG. 3 shows a terminal strip, which is referenced 20' therein, with a ferrule 22 assembled to, and secured to, each terminal 10, the strip 20' being the product of the machine described below.

Figure 4:
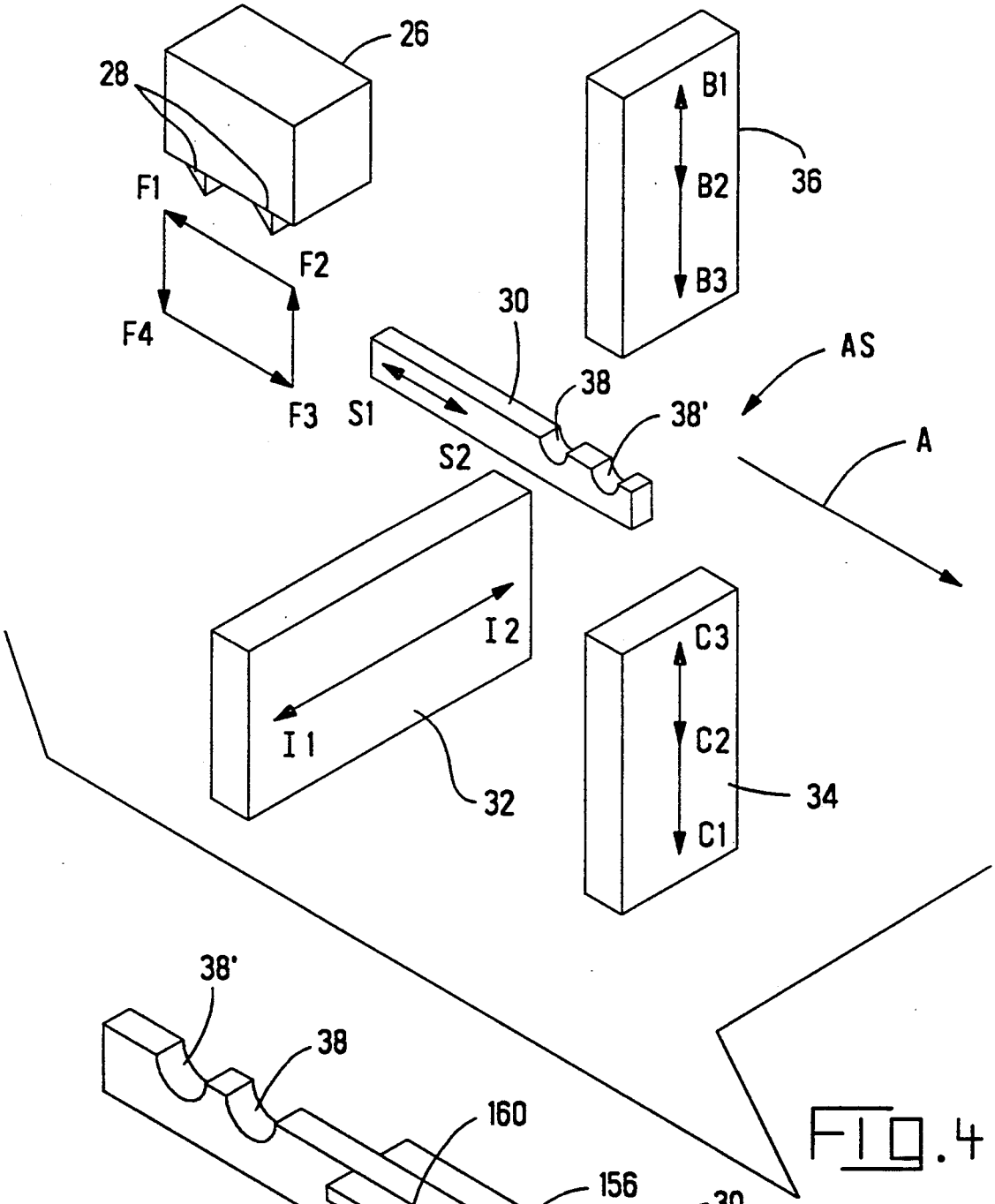
FIG. 4 is a block diagram illustrating, in basic form, the operation of a machine for applying the ferrules to the terminals.

The machine and its operation will be now described, briefly and in outline, with reference to FIG. 4. The machine comprises basically, a terminal strip feed member 26 from which depend a pair of feed fingers 28, a component feed shuttle 30, for the ferrules 22, assembly means in the form of a ferrule inserter 32 and ferrule securing means in the from of a crimper 34 and a back-up member 36. The feed member 26 is arranged to feed the strip 20, with the portions 14 of the terminals 10 directed towards the shuttle 30, along a feed path in a direction indicated by the arrows A in FIG. 4. The shuttle 30 is moveable in the feed direction indicated by the arrows A, between two end positions S1 and S2, the inserter 32 being moveable towards and away from the shuttle 30, at right angles to the feed direction, between end positions I1 and I2, the crimper 34 and the back-up member 36 being moveable towards and away from one another between end positions C1 and C3 and B1 and B3, respectively, at right angles to the feed direction indicated by the arrows A. The feed member 26 is moveable horizontally between end positions F2 and F1 and F3 and F4 and is moveable vertically between positions F3 and F2 and F1 and F4 as indicated by arrows. A cycle of the machine will now be described. Initially, the back up member 36 is its retracted position Bl, the crimper 34 being in its retracted position Cl, the inserter 32 being in its retracted position Il, the shuttle 30 being in its retracted position at Sl and the feed member 26 being a lowered and a retracted position F4 with the feed fingers 28 engaging each in a respective pilot hole 18 of the carrier strip 12. As will be described in detail below, all of the machine parts referred to above, are driven by means of a common, rotary disc cam. With the machine parts positioned as described above, at the beginning of a revolution of the disc cam, the parts are moved thereby as follows The feed member 26 is moved from F4 to F3 so as to advance the strip 20 a distance corresponding to the pitch of the terminals 10. As the feed member 26 begins to advance, the crimper 34 and the back-up member 36 begin to move forward to positions C2 and B2, respectively, the shuttle 30 into an end receptacle 38′ of which a ferrule 20 was fed during a previous cycle of operation being stationary at position S1. The feed member 26 is raised to position F2. Before the crimper 34 and backup member 36 are fully seated (at positions C3 and B3, respectively) against the leading terminal 10 of the strip 20, the inserter 32 is advanced from position I1 to I2 and inserts the ferrule 22 in the receptacle 38′ over the leading terminal 10 at assembly station AS. Crimper 34 and the back-up member 36 then complete their movements to C3 and B3, respectively, to crimp the ferrule 22 to the terminal 10 and thus to secure it thereto. During this time, the feed member 26 has been retracted in its raised position, to position Fl. The inserter 32, the crimper 34, the back-up member 36 are then retracted to positions I1, C1 and B1 respectively, the feed member 26 is lowered to position F4 the shuttle 30 is advanced to position S2 to locate the trailing receptacle 38 of the shuttle 30 at the assembly station AS at which the insertion and crimping operations described above occurred. The disc cam has then completed a half revolution. During the next half revolution of the disc cam, the machine parts described above, are moved through their working strokes in the manner described above, excepting that the ferrule 22 in the trailing receptacle 38 is assembled to the next following terminal 10 and the shuttle 30 is retracted to position S1 instead of being advanced to position S2. During each revolution of the disc cam, the assembly of a ferrule 22 to each of two terminals 10, is completed.

Figure 5:
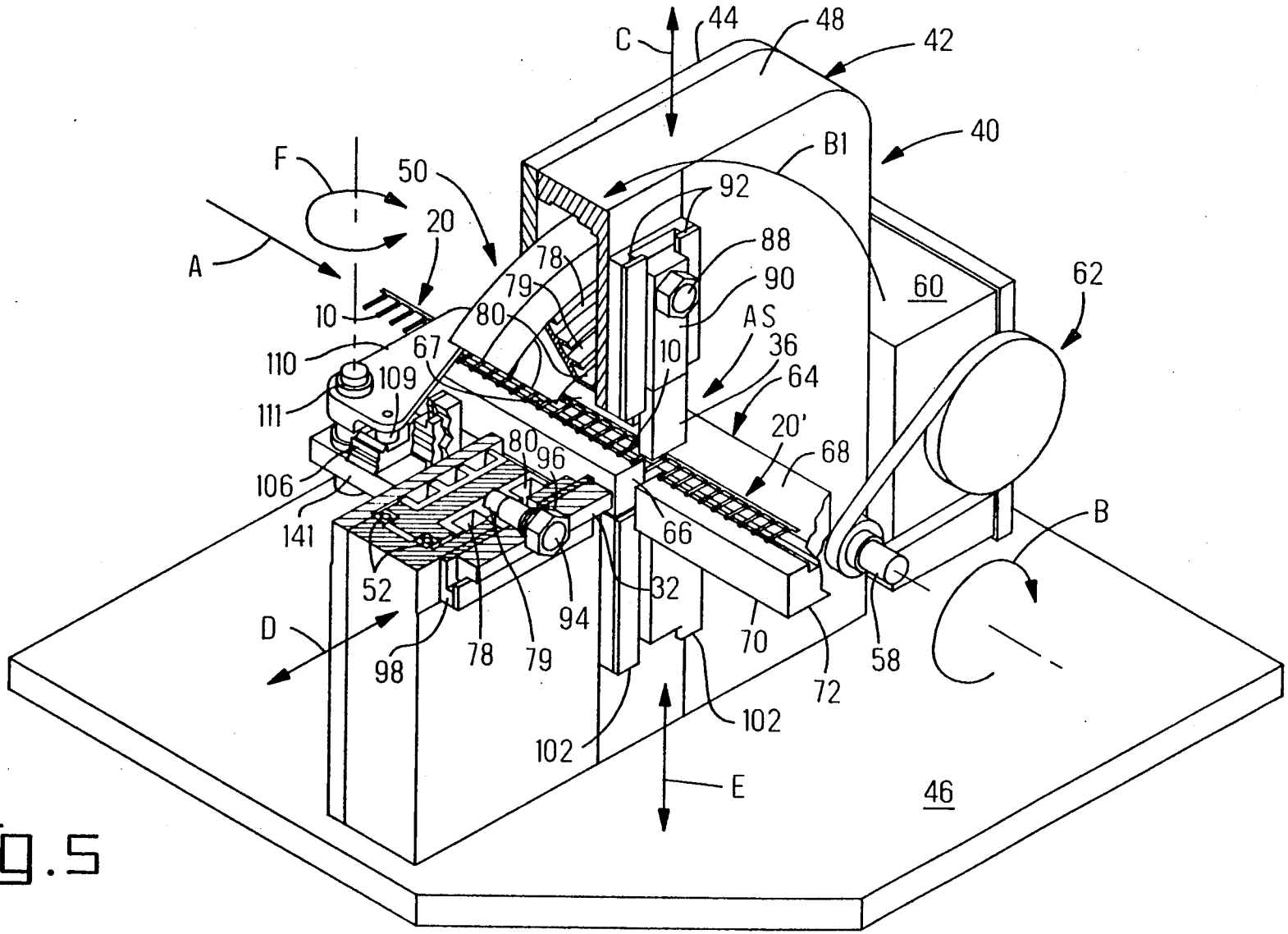
FIG. 5 is a partially diagrammatic isometric view of the machine, with parts omitted.
Figure 6:
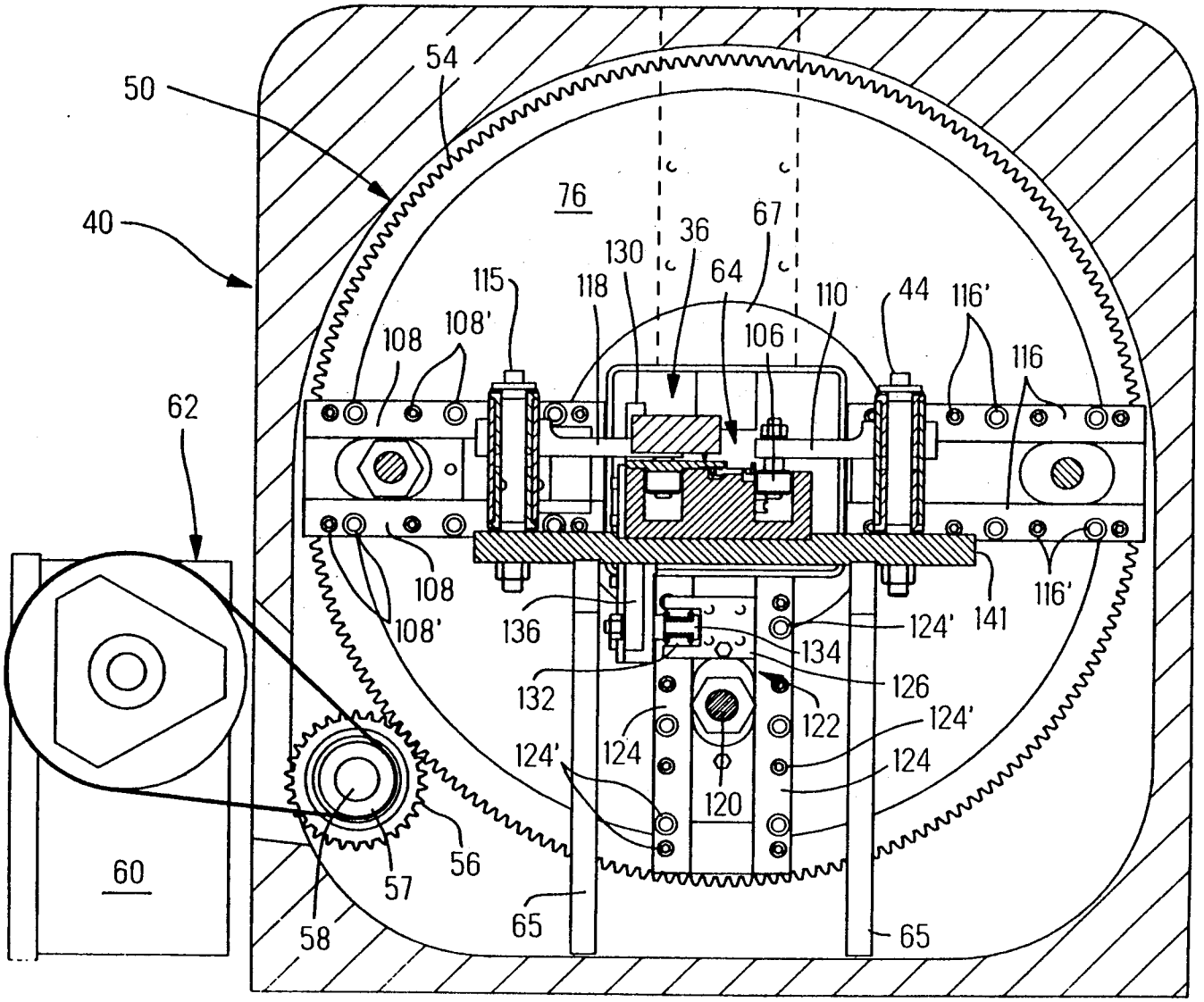
FIG. 6 is a partly diagrammatic side view of the machine, shown partly in section, and taken through a frame thereof.
Figure 7:
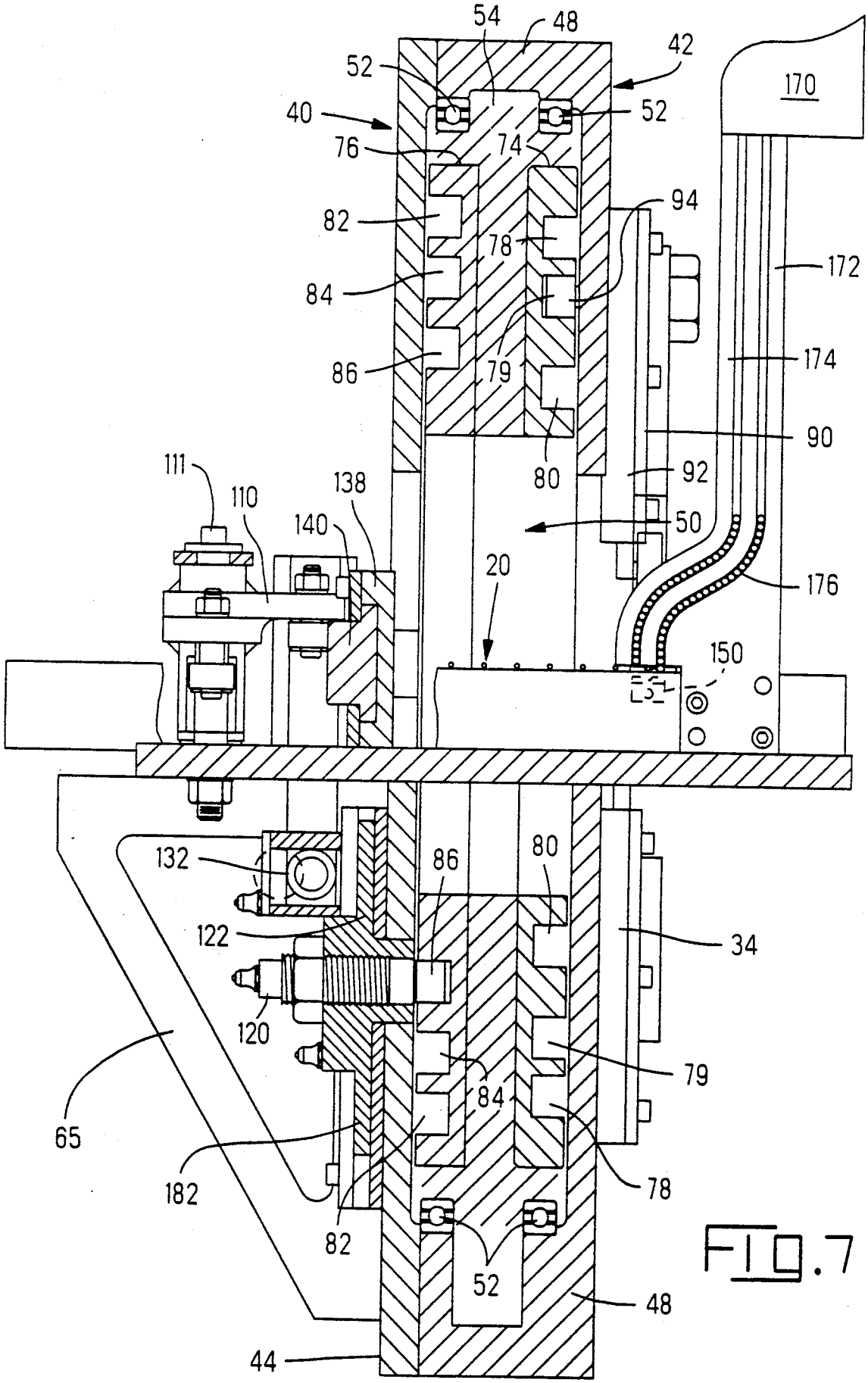
FIG. 7 is a partly diagrammatic axial sectional view of the machine.
Figure 9:
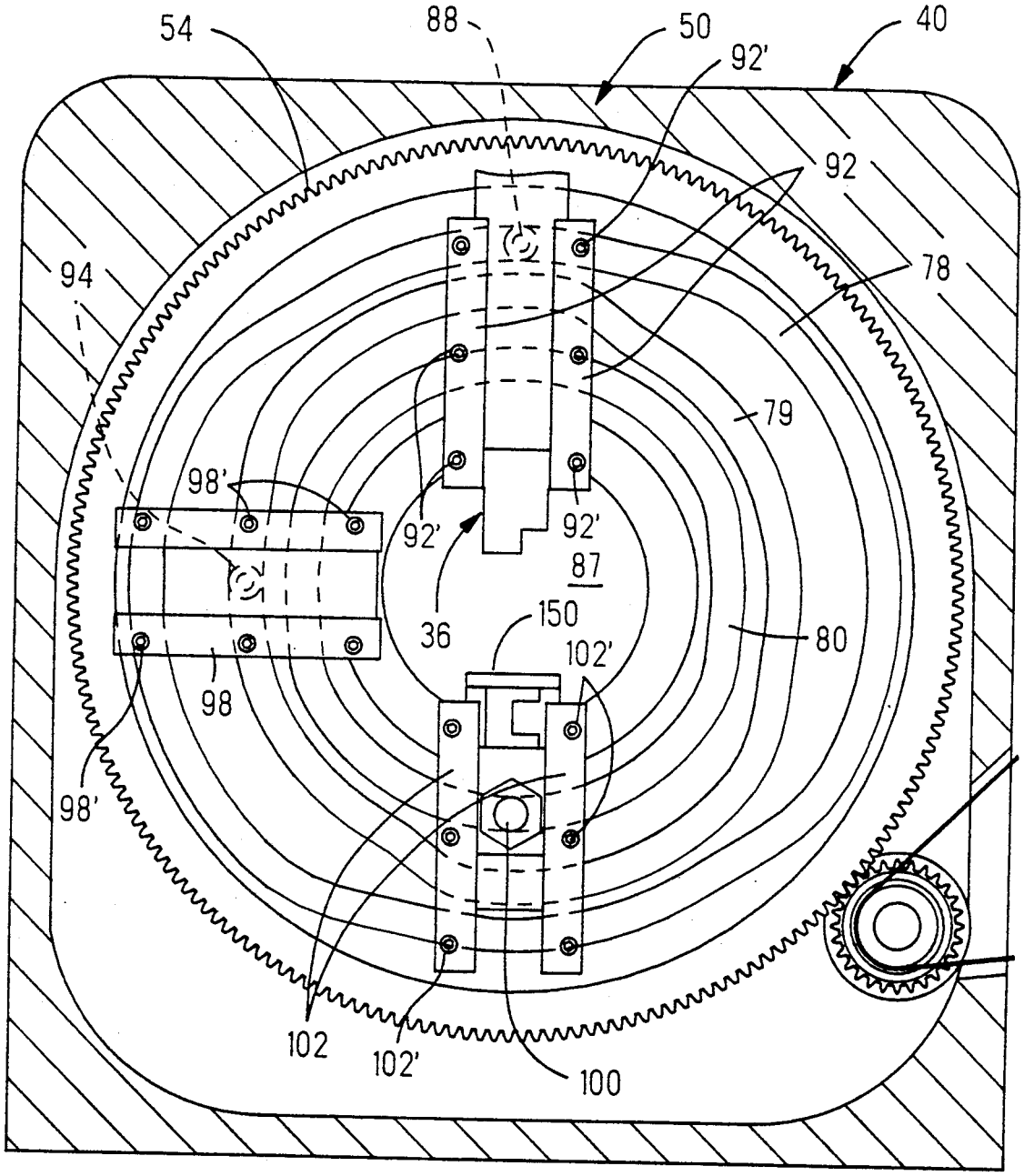
FIG. 9 is a view, taken through said frame, showing one side of a rotary disc cam of the machine.
Figure 10:
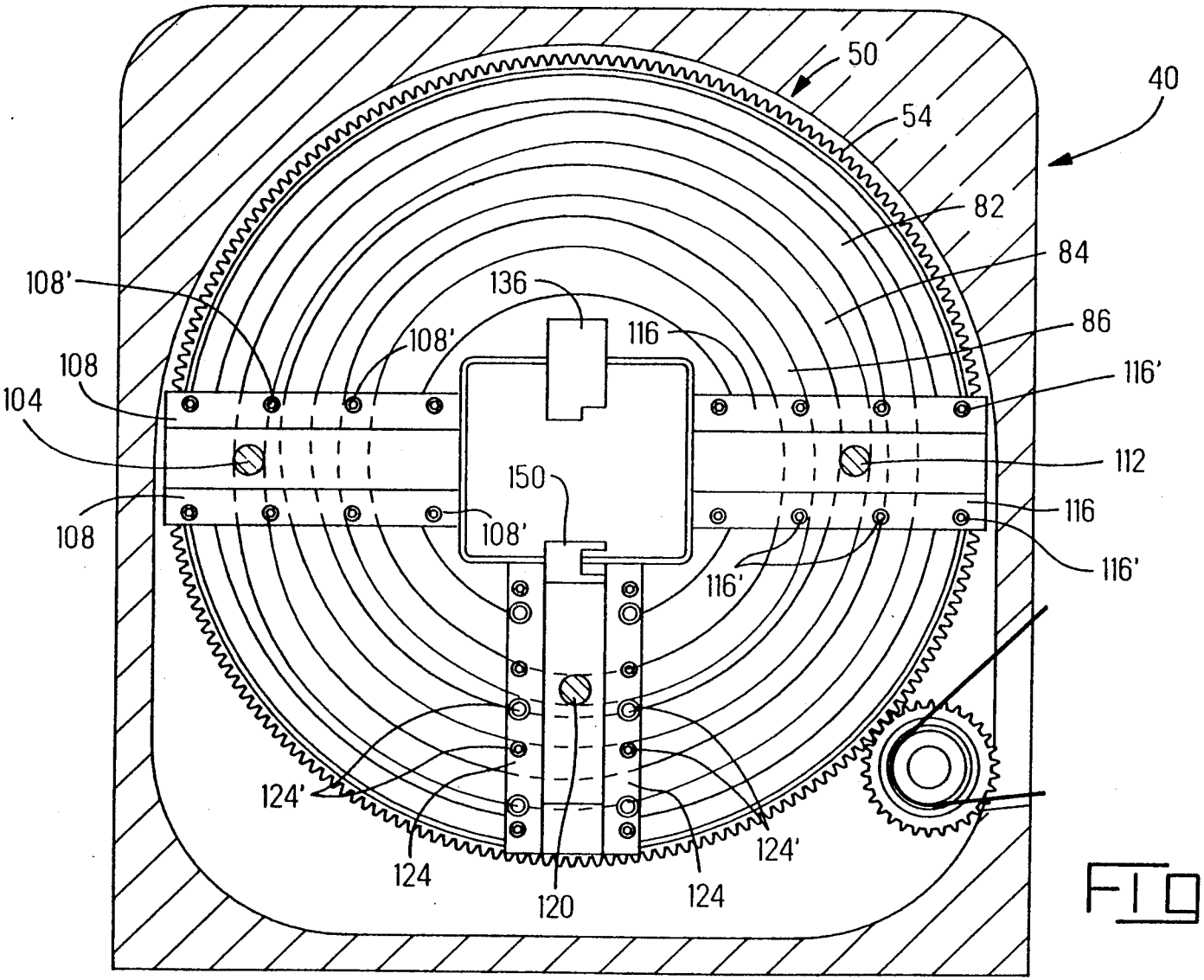
FIG. 10 is a view similar to that of FIG. 9, but showing the opposite side of the disc cam.

As shown in FIGS. 5 to 8, the machine comprises a frame 40 provided by juxtaposed frame plates 42 and 44, supported on a work table 46. The plate 42 which comprises a peripheral flange 48 projecting normally therefrom, cooperates with the plate 44 to enclose the disc cam mentioned above, which is generally referenced 50. As best seen in FIG. 7, the disc cam 50 is rotably mounted to the flange 48, is thus rotably mounted in the frame 40, by means of parallel ball bearings 52, between which the disc cam 50 is provided with peripheral teeth 54, which mesh as shown in Figure 6, with the teeth 56 of a spur gear 57 on a shaft 58 journaled in the side plates 42 and 44 and being connected with a drive electrical motor in a motor housing 60 mounted on the work table 46 beside the frame 40, by means of a belt drive assembly 62. Motor is arranged to drive the disc cam 50 in continuous rotation, at an even angular speed in the bearings 52. A feed track 64 for the strip 20, 20′ supported in the plates 42 and 44 and extending at right angles to the axis of rotation of the disc cam 50 through a central opening 67 therein is provided with a tooling access notch 66 at the assembly station AS, extending beneath the leading terminal 10 of the strip 20 and opening into the upper, strip supporting surface 68 of the track 64, into its leftward (as seen in FIG. 5) surface 70 and into its lower surface 72. As shown in FIG. 7, the disc cam 50 has recessed therein, a cam plate 74 on its right hand, inserter side, and an opposed, aligned cam plate 76 on its lefthand (as seen in FIG. 7), feed side. The plate 74 is formed with three cam tracks 78, 79 and 80, the cam plate 76 being formed with three cam tracks 82, 84 and 86 respectively. Each cam track is endless and extends about the axis of rotation of the disc cam 50. The configuration of the cam tracks 78 to 80 and 82, 84 and 86 is shown in FIG. 9 and 10. A cam follower 88 in the cam track 78 is connected via a slot in the plate 42 to a pilot and hold down slide 90, slideably mounted in gibs 92 on the frame plate 42 for vertical reciprocating movement (arrow C in FIG. 5) at right angles to the axis of rotation of the disc cam 50 as the latter is rotated in a counter clockwise sense by the motor which will be apparent from the arrows B and B1 in FIG. 5. The slide 90 carries at its radially inner end, the backup member 36 which acts as terminal hold down and pilot member as described below. In the cam track 79 is a cam follower 94 which extends through the slot 96 (FIG. 5) in the side plate 42 and is connected to the inserter 32 which is slideable in a slideway 98 for reciprocating movement towards and away from the assembly station AS and at right angles to the feed track 64 and thus radially of the disc cam 50, as it is rotated in the direction of arrow E. In the cam track 80, is a cam follower 100 which is connected to the crimper 34 which is slideable in the gibs 102 radially of the disc cam 50 towards and away from the assembly station AS as indicated by the arrow E in FIG. 5, as the disc cam 50 is rotated.

Figure 8:
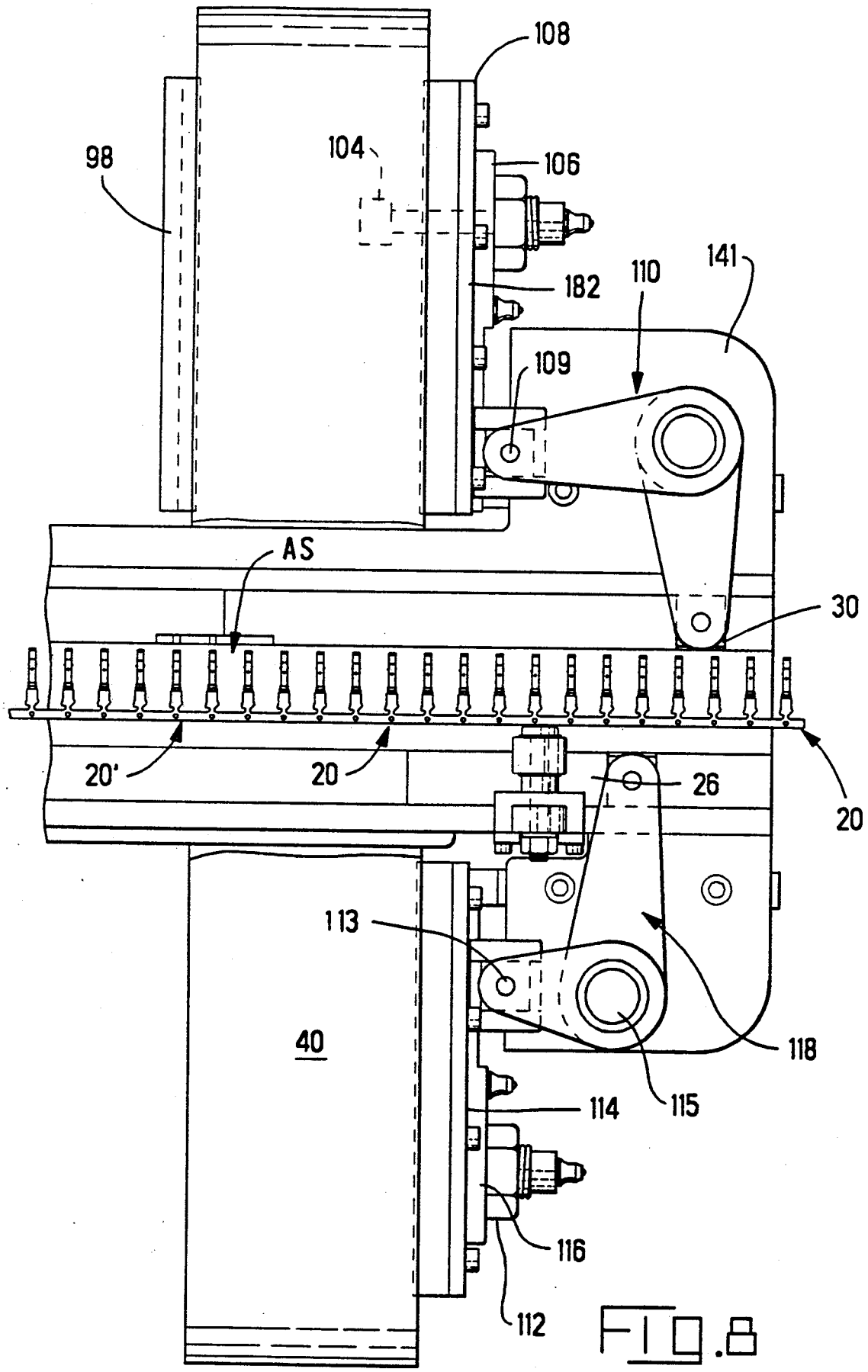
FIG. 8 is a partly diagrammatic fragmentary plan view of the machine, shown partly in section.

In the cam track 82 of the cam plate 76 is a cam follower 104, which as shown in FIG. 8, is connected to a feed slide 106 which is slideable in gibs 108 on the side plate 44, radially of the disc cam 50 and which is connected by way of a spigot 109, to a rocker 110, in the form of a bell crank pivoted about a pin 111, as indicated by the arrow F, for driving the shuttle 30 which is moved between its two end positions during each revolution of the disc cam 50. A cam follower 112 in the cam track 84 is connected to a slide 114 which is slideable in gibs 116 radially of the disc cam 50, slide 114 being connected by way of a spigot 113 to a rocker 118 in the form of a bell crank which is pivotable about a pin !15 and which is connected to the feed member 26 in horizontal reciprocating movement as the disc cam 50 is rotated. A cam follower 120 in the cam track 86 is connected to a slide 122, as best seen in FIG. 7 a lowered portion of which is slideable in gibs 124 on the plate 44 as best seen in FIGS. 6 and 7, radially of the disc cam. As will be apparent from FIGS. 6, 7, 16 and 17, the feed member 26 with its depending feed fingers 28, is mounted to the top of an upper portion 130 of the slide 122 which is coupled to said lower portion 126 thereof by way of a roller 132 which is moveable along a horizontal slot 134 in the slide portion 126, the slide portion 130 being vertically slideable in a slide holder 136 which is in turn received in a horizontal slide 138 which is horizontally moveable in a further slide holder 140, by the rocker arm 118. The two end positions of the roller 132 are shown in FIGS. 7 and 17. The rockers 110 and 118 are mounted on a platform 141 projecting from the side plate 44, and being supported by brackets 65 thereon. The gibs 92 and 102 and the slideway 98 are secured to the frame plate 42 by means of fasteners 92', 102' and 98', respectively, and the gibs 108, 116 and 124 are secured to the frame plate 44 by means of fasteners 108', 116' and 124', respectively.

The back-up member 36 comprises, as best seen in FIG. 14, a main block 140, secured to the slide 90 by means of a tongue and slot connection 141 and having slideably mounted therein a spring loaded pilot pin 142 for insertion through pilot hole 18 of the carrier strip 12 at the assembly station AS, the pin 12 projecting beneath the block 140. Also secured to the block 140 projecting therebeneath is a terminal hold down tool 144 having a semi-circular cross section recess 146 for engaging about the barrel portion 14 of the terminal 10 at the station AS.

The crimper 34 has mounted in its upper end, a four sided crimping tool 150 (Figure !4) which is mounted for angular adjustment about its axis 152 in a slot 154 the upper surface of the crimper 34, to bring a desired crimping recess 156 thereof to a position to project upwardly from the slot 154 to crimp a ferrule 22 to the barrel 14 of the terminal 10 when held down against the upper surface of the crimper 34 by the hold down tool 144. In Figures other than FIG. 14, the tool 150 is shown only diagrammatically.

As shown in FIG. 12, the shuttle 30 comprises a slide body 156 which is mounted between the gibs 116 and which has a central longitudinal slot 158 slidably receiving a shuttle tool 160, the upper surface of which is formed with the receptacles 38 and 38', the shuttle tool 160 being longitudinally adjustable the body 156 by means of an adjusting screw 162.

Figure 11:
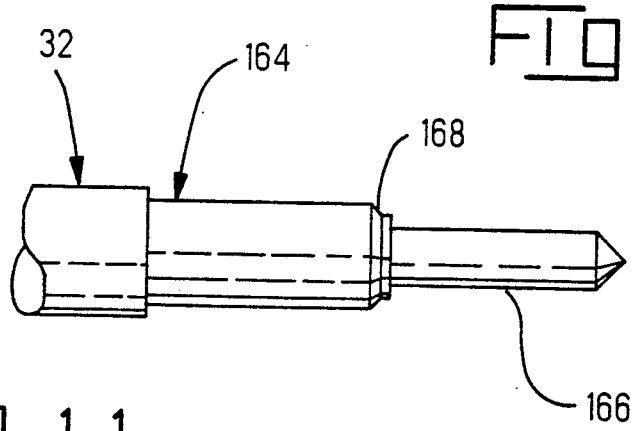

The inserter 32 carries at its end nearest to the assembly station AS, an insertion tool 164 which is shown in FIG. 11 and which has a reduced cross section free end portion 166 for receiving a ferrule 22 from the receptacle 38 or 38' of the shuttle tool 160, as the inserter 32 is advanced towards the assembly station AS, for insertion in the barrel portion 14 of the terminal 10 thereat so that the ferrule 22 is pushed over the barrel 14 by means of an abutment shoulder 168 behind the reduced cross section portion 166. The shuttle tool 160 is fed with the ferrules 22 by means of vibratory feed bowl 170, shown diagrammatically in FIG. 7, and which contains a supply of the ferrules 22 in loose-piece form. The feed bowl 170 communicates with a ferrule feed track 172, which is best seen in FIG. 15 and which comprises two parallel feed conduits 174 and 176 leading to the assembly station AS and down which the ferrules 22 are fed by gravity. The shuttle tool 160 is slideable with the shuttle 30 with the upper surface of the tool 160 in which the receptacles 38 and 38' formed, by closely adjacent to feed openings 178 and 180, respectively, of the conduits 174 and 176, so that when the shuttle 30 is in its SI position, the ferrule 22 is loaded into the receptacle 38 and when the shuttle 30 is in its S2 position a ferrule 22 is loaded into the receptacle 38'.

FIG. 13 shows diagrammatically the hold down tool 144 about to descend on the barrel portion 14 of terminal 10 at the station AS the pilot pin 142 engaged in the pilot hole 18 of the carrier strip 12 holds the terminal 10 at the station AS in position, the insertion tool 164 about to pick up a ferrule 22 from the shuttle tool 160 and the crimping tool 150 approaching the barrel portion 14. When the tool 164 has pushed the ferrule 22 over the barrel portion 14, the hold down tool 144 cooperates with the crimping tool 160 to crimp the ferrule 22 to the barrel portion 14.

FIG. 18 shows the path of movement of a feed finger 28 of the feed member 26 between its FI and F2, F2 and F3, F3 and F4 and its F4 and Fl positions.

FIG. 19 is a timing diagram which indicates the configuration of the cam tracks of the disk cam 50 in terms of the movements of the feed member 26, the shuttle 30, inserter 32, the back-up member 36, and the crimper 34. The positions of these parts as designated with reference to FIG. 4, being shown in FIG. 19.

In FIG. 19, line 1 shows the horizontal movements of the feed member 26, line 2 shows the horizontal movements of the shuttle 30, line 3 shows the vertical movements of the feed member 26, line 4 shows the horizontal movements of the inserter 32, line 5 shows the vertical movements of the back-up member 36 and line 6 shows the vertical movements of the crimper 34. As indicated at the top of the diagram the movements all take place during 180 degrees of rotation of the disc cam 50. In line 2, the movement of the shuttle during the remaining 180 degrees is indicated in broken lines.

We claim:

1. A method of assembling components to electrical terminals connected together in side by side spaced relationship by means of a carrier strip, the method comprising the steps of:

(a) feeding the carrier strip lengthwise thereof through a component assembly station along a feed path to position a first terminal of the carrier strip at the assembly station;

(b) advancing a shuttle having a first component located at a first position thereon, to align that component with said first terminal at the assembly station, whilst placing a second component on the shuttle at a second position spaced from said first position;

(c) transferring said first component from the shuttle onto said first terminal to assemble said first component thereto;

(d) feeding the carrier strip lengthwise thereof along said feed path by a second step to position a second terminal of the carrier strip at the assembly station.

(e) retracting the shuttle to align said second component with said second terminal, whilst placing a further component on the shuttle at said first position thereon;

(f) transferring said second component from the shuttle onto the second terminal to assemble the second component thereto; and (g) repeating steps (a) to (c) in respect of the further component.

2. A method as claimed in claim I, comprising the step of securing each of said first and second components to said first and second terminals, respectively, upon the completion of steps (c) and (f), respectively.

3. A method as claimed in claim 2, comprising the steps of holding said carrier strip stationary at the assembly station immediately before each of the steps (c) and (f) and holding said first and second terminals down while securing said first and second components thereto.

4. A method as claimed in claim 1, wherein steps (a) and (d) comprise the steps of engaging a feed finger in a pilot hole in the carrier strip and advancing the feed finger along the feed path to feed the carrier strip by said first step, withdrawing the feed finger from the pilot hole and retracting the feed finger lengthwise of the feed path to align the feed finger with a second pilot hole in the carrier strip, engaging the feed finger in the second pilot hole and advancing the feed finger along the feed path to feed the carrier strip by said second step.

5. A method as claimed in claim 1, wherein steps (b) and (a) are carried out by moving the shuttle lengthwise of the feed path, and steps (c) and (f) are carried out by driving said first and second components onto said first and second terminals, respectively, in a direction at right angles to the feed path.

6. A method of assembling ferrules to electrical terminals connected together in parallel spaced relationship by means of a carrier strip and each comprising a mating portion, said mating portions projecting in the same direction normally of the carrier strip and being constantly spaced from each other by a predetermined pitch, the method comprising the steps of;

(a) applying a feed finger to the carrier strip to feed it by said predetermined pitch along a rectilinear feed track through a ferrule assembly station to position the mating portion of a first terminal of the carrier strip at the assembly station;

(b) advancing lengthwise thereof and lengthwise of said feed track, an elongate shuttle having forward and rear ferrule receiving receptacles spaced from each other lengthwise of the shuttle, with a first ferrule in said rear receptacle, to position that ferrule in axial alignment with the mating portion of the first terminal and simultaneously feeding a second ferrule into the forward receptacle;

(c) applying an insertion tool to said first ferrule, in a direction transversely of said feed track to drive that ferrule onto the mating portion of said first terminal;

(d) securing said first ferrule to said first terminal;

(e) applying the feed finger to said carrier strip to feed it along said feed track by said predetermined pitch to position the mating portion of a second terminal of the carrier strip at the assembly station;

(f) retracting the shuttle lengthwise thereof and lengthwise of said feed track to position said second ferrule in axial alignment with the mating portion of said second terminal and simultaneously feeding a further ferrule into said rear receptacle;

(g) applying the insertion tool to the second ferrule, in a direction transversely of the feed track, to drive that ferrule over the mating portion of said second terminal;

(h) securing said second ferrule to said second terminal; and (i) repeating steps (a) to (d) in respect of said further ferrule.

7. A method as claimed in claim 6, wherein steps (d) and (h) are carried out by engaging a back-up tool and a crimping tool with said first and second ferrules, respectively, in a direction at right angles to the carrier strip, with said insertion tool engaged in the mating portion of the respective terminal.

8. A method as claimed in claim 6, comprising the step of inserting a pilot tool into a pilot hole in the carrier strip immediately before steps (c) and (g) respectively, and withdrawing the pilot tool from the pilot hole before steps (e) and (i), respectively.

9. A method as claimed in claim 8, wherein steps (d) and (h) are carried out by engaging a crimping tool and a back-up tool with the ferrule from opposite sides thereof, the pilot tool being carried by the back-up tool.

* * * * *